US008776655B2

(12) United States Patent
Lin

(10) Patent No.: US 8,776,655 B2
(45) Date of Patent: Jul. 15, 2014

(54) WORKTABLE FOR CIRCULAR SAWS

(75) Inventor: Yi-Yuan Lin, Taichung (TW)

(73) Assignee: Rexon Industrial Corp., Ltd., Taichung (TW)

( * ) Notice: Subject to any disclaimer, the term of this patent is extended or adjusted under 35 U.S.C. 154(b) by 297 days.

(21) Appl. No.: 13/334,214

(22) Filed: Dec. 22, 2011

(65) Prior Publication Data

US 2012/0160072 A1 Jun. 28, 2012

(30) Foreign Application Priority Data

Dec. 28, 2010 (TW) ..... 99146368 A

(51) Int. Cl.
*B27B 5/24* (2006.01)
*B27B 27/10* (2006.01)

(52) U.S. Cl.
USPC ..... 83/468.3; 83/490; 83/471.3; 83/473

(58) Field of Classification Search
USPC ..... 83/471.3, 471.2, 471.1, 477, 467.1, 83/468.1, 468.2, 468.3, 468.4, 474, 381, 83/581, 466
See application file for complete search history.

(56) References Cited

U.S. PATENT DOCUMENTS

| | | | | |
|---|---|---|---|---|
| 4,934,233 | A * | 6/1990 | Brundage et al. | 83/397 |
| 5,181,448 | A * | 1/1993 | Terpstra | 83/468.3 |
| 8,495,939 | B2 * | 7/2013 | Kani et al. | 83/490 |
| 2002/0100350 | A1 * | 8/2002 | Brazell | 83/438 |
| 2009/0235797 | A1 * | 9/2009 | Kani et al. | 83/477 |
| 2010/0043614 | A1 | 2/2010 | Gehret et al. | |
| 2011/0167977 | A1 * | 7/2011 | Xu et al. | 83/471.2 |

* cited by examiner

*Primary Examiner* — Kenneth E. Peterson
*Assistant Examiner* — Jennifer Swinney
(74) *Attorney, Agent, or Firm* — Bacon & Thomas, PLLC

(57) ABSTRACT

A worktable for a circular saw includes a rotatable table defining a cutting groove, two movable fences arranged on the rotatable table at two opposed sides relative to the cutting groove, and a connection member connected between the two movable fences. The connection member has an arc-shaped locating groove and is adapted for engagement with a guide member of the rotatable table so that when the rotatable table is rotated, the guide member engages and applies a force to the wall of the arc-shaped locating groove, causing the two movable fences to be moved relative to the cutting groove, and therefore the two movable fences are maintained spaced away from the cutting groove at a distance without interfering with the operation of the saw blade.

10 Claims, 10 Drawing Sheets

WORKTABLE FOR CIRCULAR SAWS

This application claims, under 35 U.S.C. §119, priority to Taiwanese Application No. 099146368, filed Dec. 28, 2010, which application is hereby incorporated by reference in its entirety, inclusive of the specification, claims, and drawings.

FIELD OF THE INVENTION

The present disclosure relates to circular saws and more specifically, to a worktable for circular saws.

BACKGROUND

A conventional circular saw 10, as shown in FIG. 1, includes a base member 11, a rotatable table 12, a saw unit 13, and two fences 14. The rotatable table 12 is rotatably mounted on the base member 11 and is provided for holding a workpiece for cutting. The rotatable table 12 includes a radially extending cutting groove 122. The saw unit 13 is pivotally connected to the rotatable table 12, and includes a saw blade 132 insertable into the cutting groove 122 to cut through the workpiece supported on the rotatable table 12. The two fences 14 are affixed to the base member 11 and extend along the rotatable table 12 at two sides relative to the cutting groove 122. The two fences 14 are also provided for supporting the workpiece for cutting.

In order to cut the workpiece at different angles, the operator must rotate the rotatable table 12 to different angular positions. However, as the fences 14 are affixed to the base member 11, rotating the rotatable table 12 leads to an increase in the distance between the cutting groove 122 and one of the two fences 14. Doing so also causes a decrease in the distance between the cutting groove 122 and the other fence 14. In other words, the distance between the cutting groove 122 and each of the two fences 14 cannot be maintained during rotation of the rotatable table 12. To avoid the risk of one fence 14 being positioned too closely to the cutting groove 122, and thus interfering with the saw blade 132, the mounting positions of the fences 14 must take into consideration the safety range between each fence 14 and the saw blade 132. Therefore, due to the installation limitations of the fences 14, a small workpiece may not be provided sufficient support to ensure accurate cutting.

SUMMARY

In view of the above, one object of the present disclosure is to provide a worktable for a circular saw, which maintains movable fences thereof spaced at a proper distance from the cutting groove during rotation of the rotatable table, thus avoiding interference with the saw blade.

To achieve this and other objects, according to one embodiment of the present disclosure, a worktable for a circular saw includes a base member, a rotatable table, and a fence unit. The rotatable table is rotatably mounted to the base member and has a cutting groove defined therein. The rotatable table further includes a guide member. The fence unit includes a mounting frame, a connection member and two movable fences. The mounting frame is affixed to the base member. The connection member is disposed between the rotatable table and the mounting frame, and is adapted for engagement with the guide member. The two movable fences are respectively connected to two distal ends of the connection member at two opposed lateral sides of the cutting groove, and also connected to the mounting frame and movable relative to the cutting groove.

Thus, when rotating the rotatable table, the rotatable table drives the guide member to cause movement of the connection member, thus causing the two movable fences to be moved relative to the cutting groove, and therefore the two movable fences are maintained spaced away from the cutting groove at a proper distance without interfering with the operation of the saw blade.

Further, the connection member has an arc shaped locating groove defined therein for engagement with the guide member of the rotatable table. The arc shaped locating groove has a curvature greater than a curvature of a circumference of the rotatable table.

Further, the connection member includes two angled end portions, each having a hold-down block mounted thereon. Each movable fence has a sliding groove defined therein adapted for receiving the hold-down blocks of the connection member. The sliding groove has a shoulder formed thereon, which is secured between one angled end portion of the connection member and the associated hold-down block of the connection member.

Further, the mounting frame of the fence unit has two locating blocks. Each movable fence has a sliding groove defined therein for respectively receiving the locating blocks of the mounting frame.

Further, the fence unit further includes a hold-down device mounted to the mounting frame, which engages with one locating block for driving the engaged locating block toward the corresponding movable fence to hold down the corresponding movable fence.

DETAILED DESCRIPTION

Figure 1:
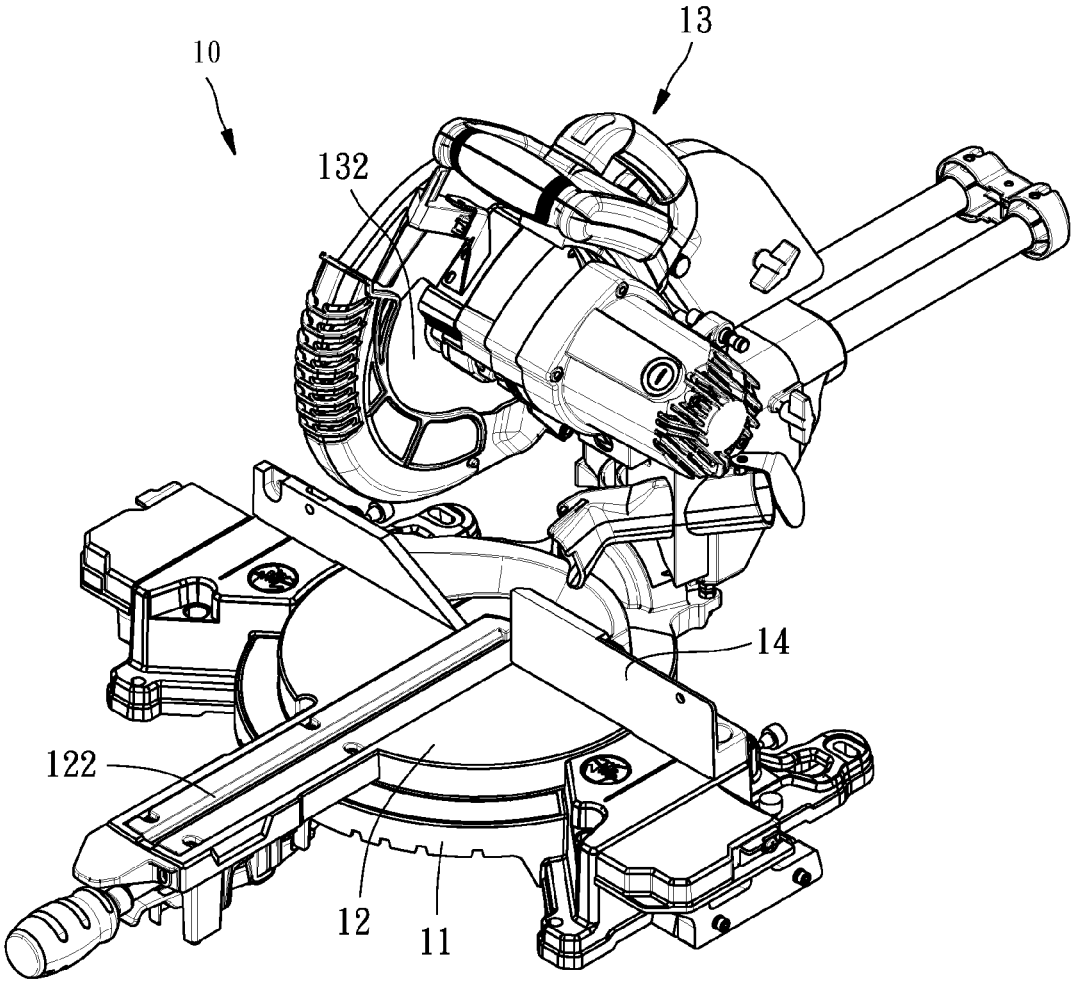
PRIOR ART FIG. 1
FIG. 1 is a perspective view of a circular saw according to the prior art.
Figure 2:
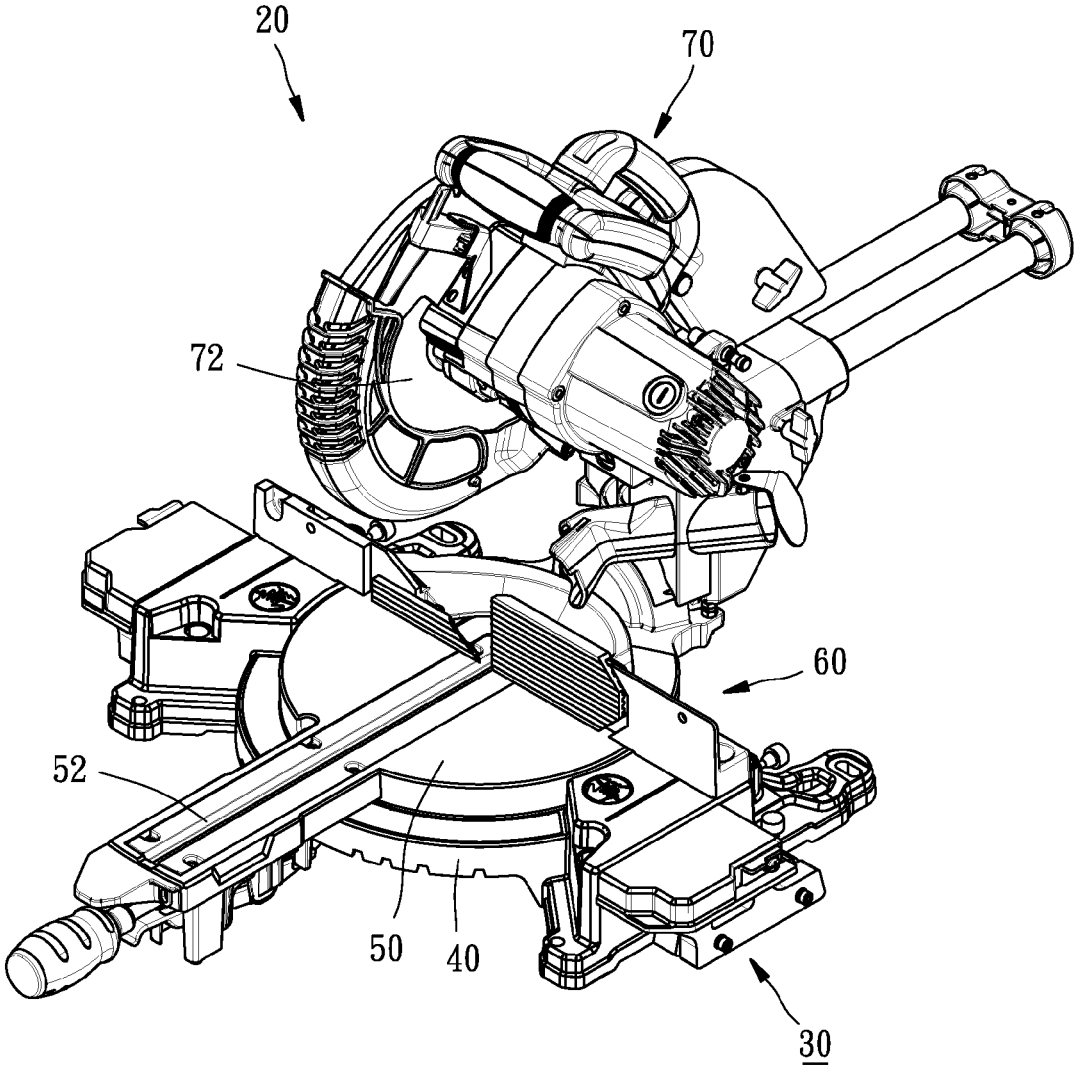
FIG. 2 is a perspective view of a circular saw in accordance with an embodiment of the present disclosure.
Figure 3:
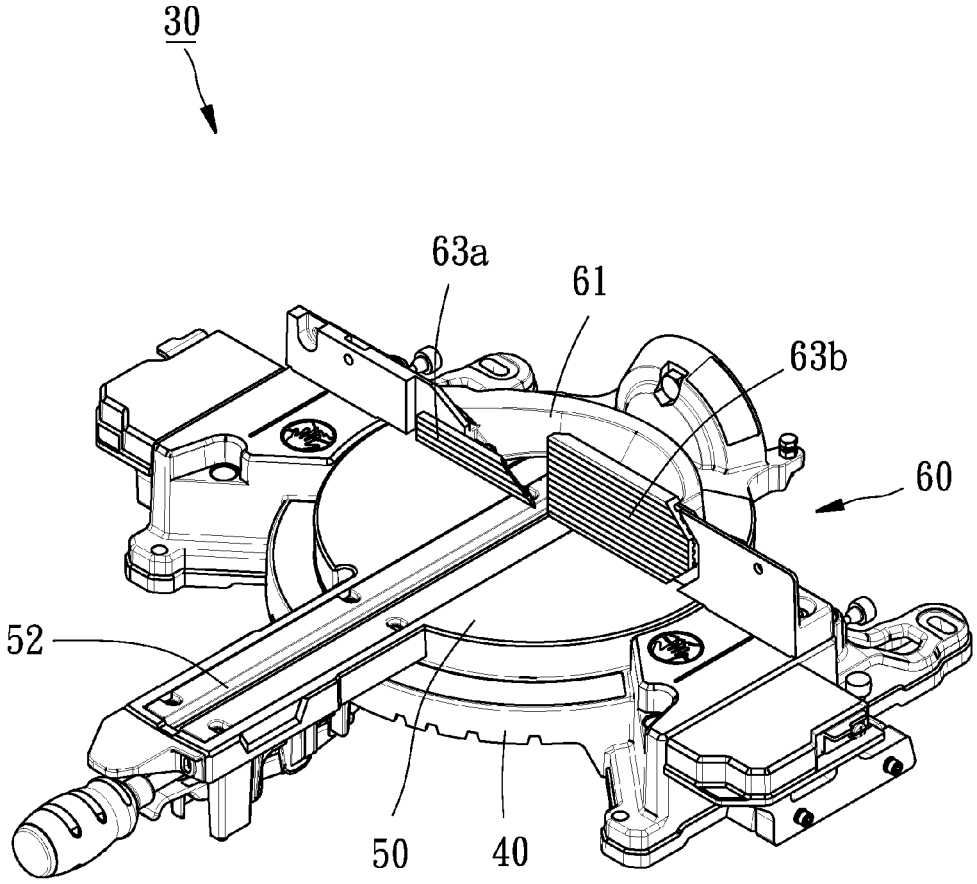
FIG. 3 is a perspective view of a worktable for a circular saw in accordance with the present disclosure.

Referring to FIGS. 2 and 3, a worktable 30 is shown used in a circular saw 20. The worktable 30 includes a base member 40, a rotatable table 50, and a fence unit 60.

The base member 40 is adapted for supporting the rotatable table 50.

The rotatable table 50 is rotatably mounted to a top side of the base member 40, and is provided for holding a workpiece for cutting by a saw unit 70 of the circular saw 20 that is pivotally mounted to the base member 40. Further, the rotatable table 50 has a cutting groove 52 defined therein and radially extending therethrough which is adapted for allowing a saw blade 72 of the saw unit 70 to pass therethrough. Additionally, a pin is fastened to the top side of the rotatable table 50. The pin protrudingly extends in an axial direction away from the surface of the rotatable table 50, forming a guide member 54, as shown in FIG. 4.

Figure 4:
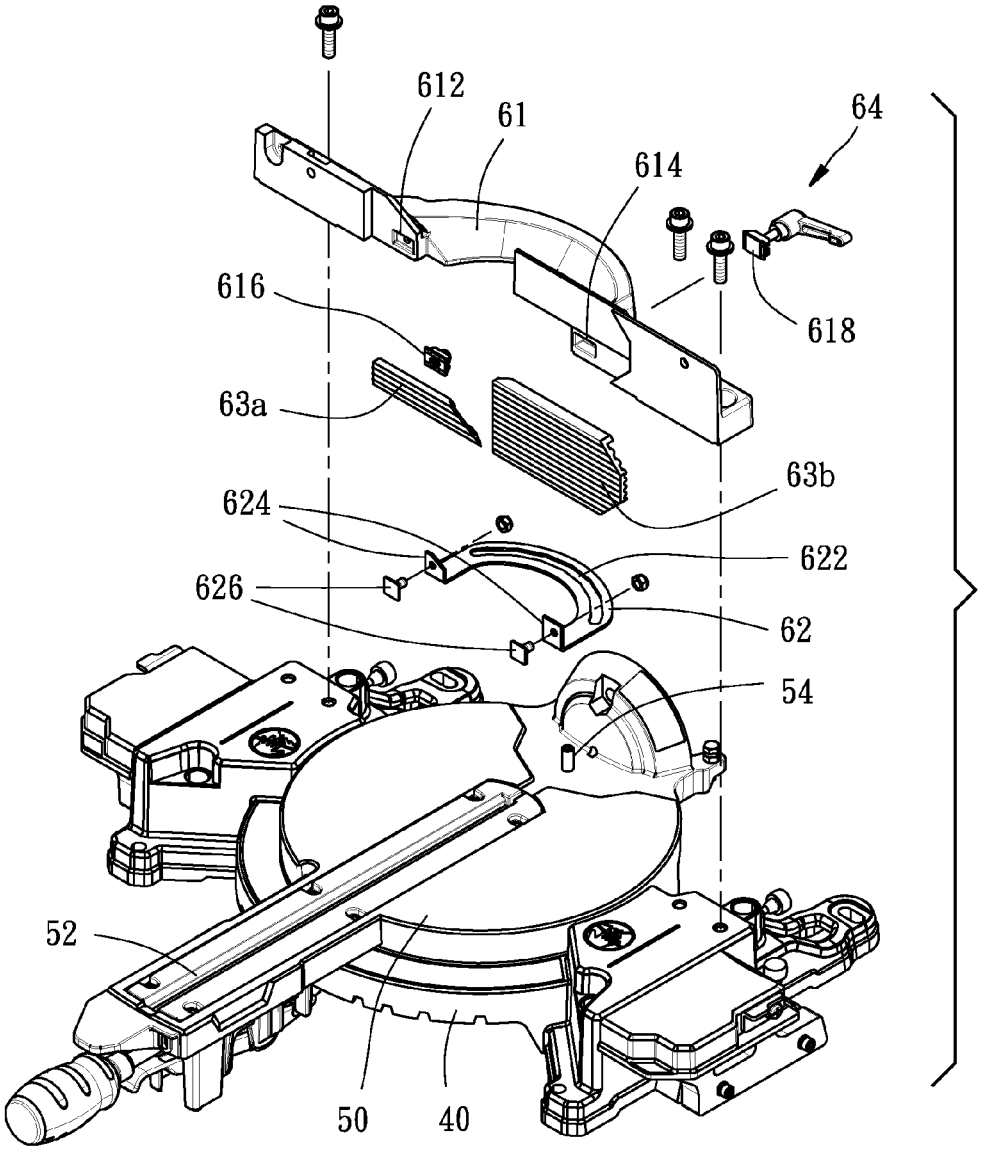
FIG. 4 is an exploded view of the worktable for the circular saw in accordance with the present disclosure.

Referring to FIGS. 3 and 4, the fence unit 60 includes a mounting frame 61, a connection member 62, two movable fences 63*a* and 63*b*, and a hold-down device 64.

The mounting frame 61 is affixed to a top of the base member 40 and extends along the top side of the rotatable table 50. The mounting frame 61 has two through holes 612 and 614 defined therein, respectively located at two ends of the mounting frame 61, and two locating blocks 616 and 618 respectively mounted in the through holes 612 and 614.

The connection member 62 is substantially arc shaped and is arranged between the rotatable table 50 and the mounting frame 61. The connection member 62 has an arc shaped locating groove 622 defined therein for engaging with the guide member 54 of the rotatable table 50. The arc shaped locating groove 622 has a curvature greater than a curvature of a circumference of the rotatable table 50. Further, the connection member 62 includes two angled end portions 624, and two hold-down blocks 626 respectively mounted to the two angled end portions 624.

Figure 6:
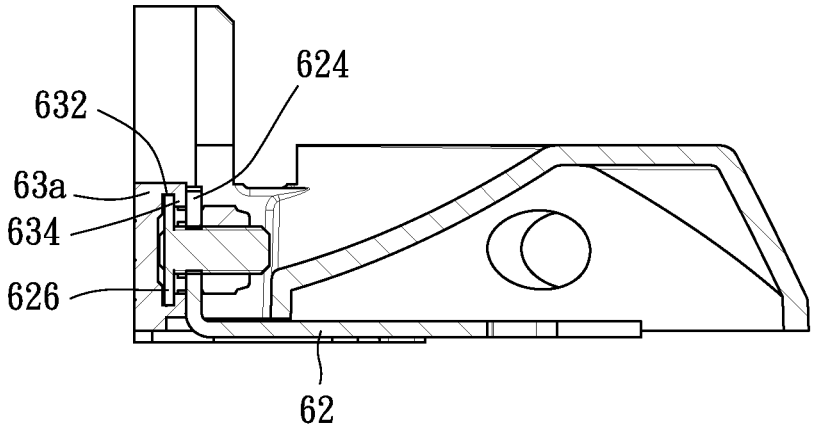
FIG. 6 is a sectional view taken along line 6-6 of FIG. 5.
Figure 7:
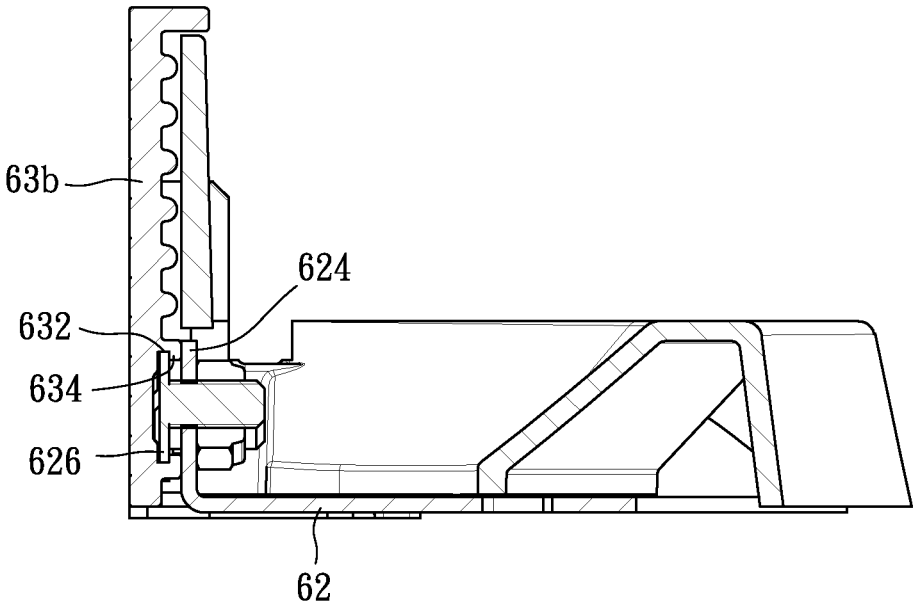
FIG. 7 is a sectional view taken along line 7-7 of FIG. 5.

As best seen in FIGS. 6 and 7, each of the movable fences 63*a* and 63*b* has a sliding groove 632 defined therein and located on a back side thereof for receiving one of the hold-down blocks 626 of the connection member 62. Each sliding groove 632 has a shoulder 634 formed thereon. When the hold-down blocks 626 are fastened tight, each shoulder 634 is respectively clamped between the two angled end portions 624 of the connection member 62 and the hold-down blocks 626, such that the movable fences 63*a* and 63*b* are secured to the two ends of the connection member 62 at two opposed lateral sides of the cutting groove 52 of the rotatable table 50.

Figure 8:
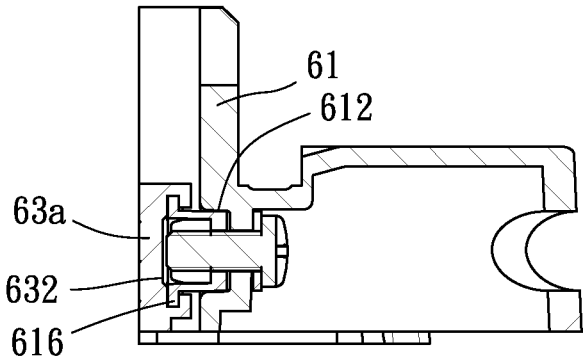
FIG. 8 is a sectional view taken along line 8-8 of FIG. 5.
Figure 9:
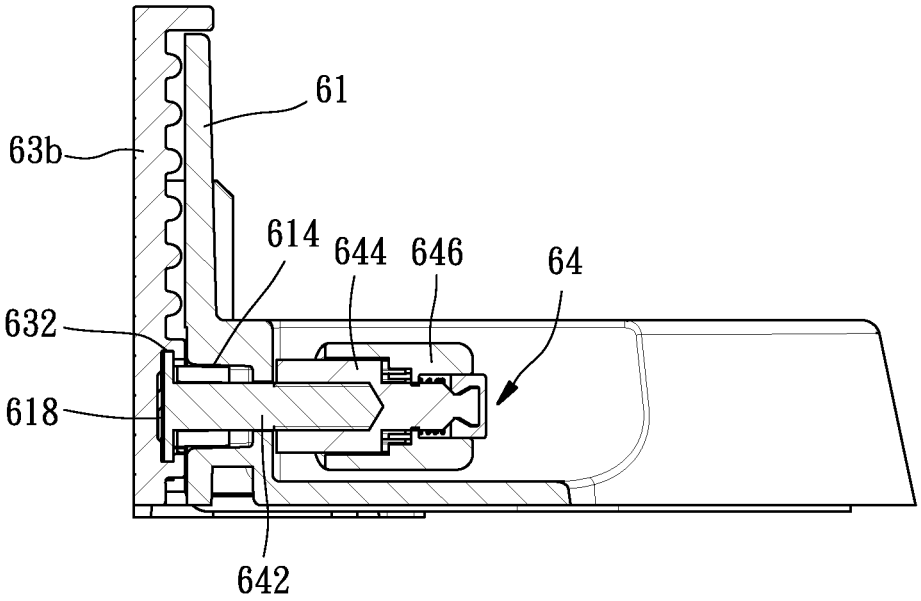
FIG. 9 is a sectional view taken along line 9-9 of FIG. 5.

Further, the sliding grooves 632 of the movable fences 63*a* and 63*b* can also receive the locating blocks 616 and 618 of the mounting frame 61, as shown in FIGS. 8 and 9, enabling the movable fences 63*a* and 63*b* to be respectively moved relative to the cutting groove 52.

Figure 5:
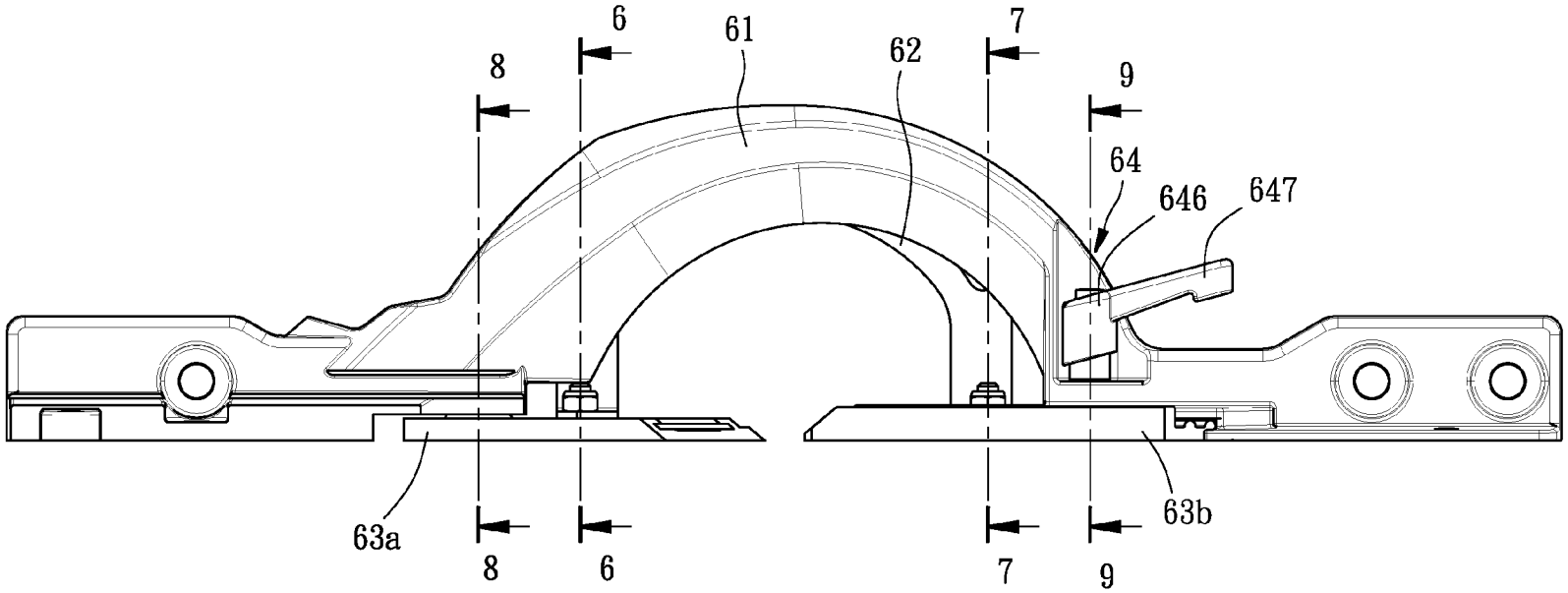
FIG. 5 is a schematic top view of a fence unit of the worktable for the circular saw in accordance with the present disclosure.

The hold-down device 64 of the fence unit 60 includes a screw bolt 642, a nut 644 and a socket 646, as shown in FIGS. 4, 5, and 9. The screw bolt 642 is inserted through the through hole 614 of the mounting frame 61, and a first end of the screw bolt 642 engages with the corresponding locating block 618. The nut 644 is threaded onto a second end of the screw bolt 642. The socket 646 is coaxially arranged on the nut 644. The socket 646 has a handle 647 which extends from a periphery thereof. When the handle 647 is moved, the socket 646 is driven to rotate, such that the nut 644 synchronously rotates with the socket, such that the locating block 618 is forced into engagement with the movable fence 63*b* by the movement of the screw bolt 642 relative to the nut 644.

Figure 10:
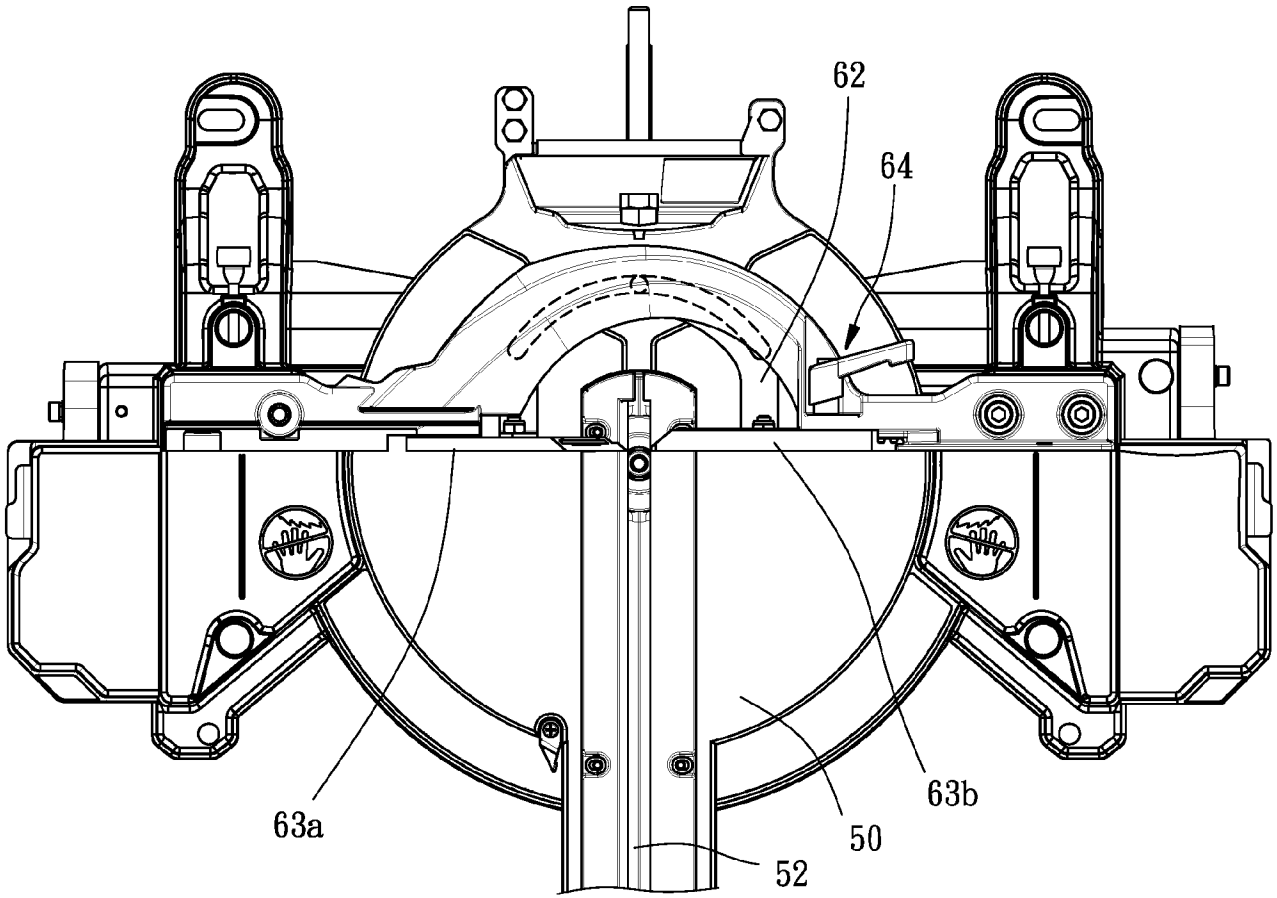
FIG. 10 is a schematic drawing of a worktable according to the present disclosure, illustrating the status of the worktable before rotation.

Before the rotatable table 50 can be rotated from the neutral position as shown in FIG. 10, the hold-down device 64 of the fence unit 60 must be manipulated to release the locating block 618 from engagement with the movable fence 63*b* for allowing movement of the movable fences 63*a* and 63*b* with the connection member 62 relative to the cutting groove 52. After adjustment of the positions of the movable fences 63*a* and 63*b* relative to the cutting groove 52, the hold-down device 64 can be fastened to lock the movable fences 63*a* and 63*b* into position, and thus the cutting operation can be performed.

Figure 11:
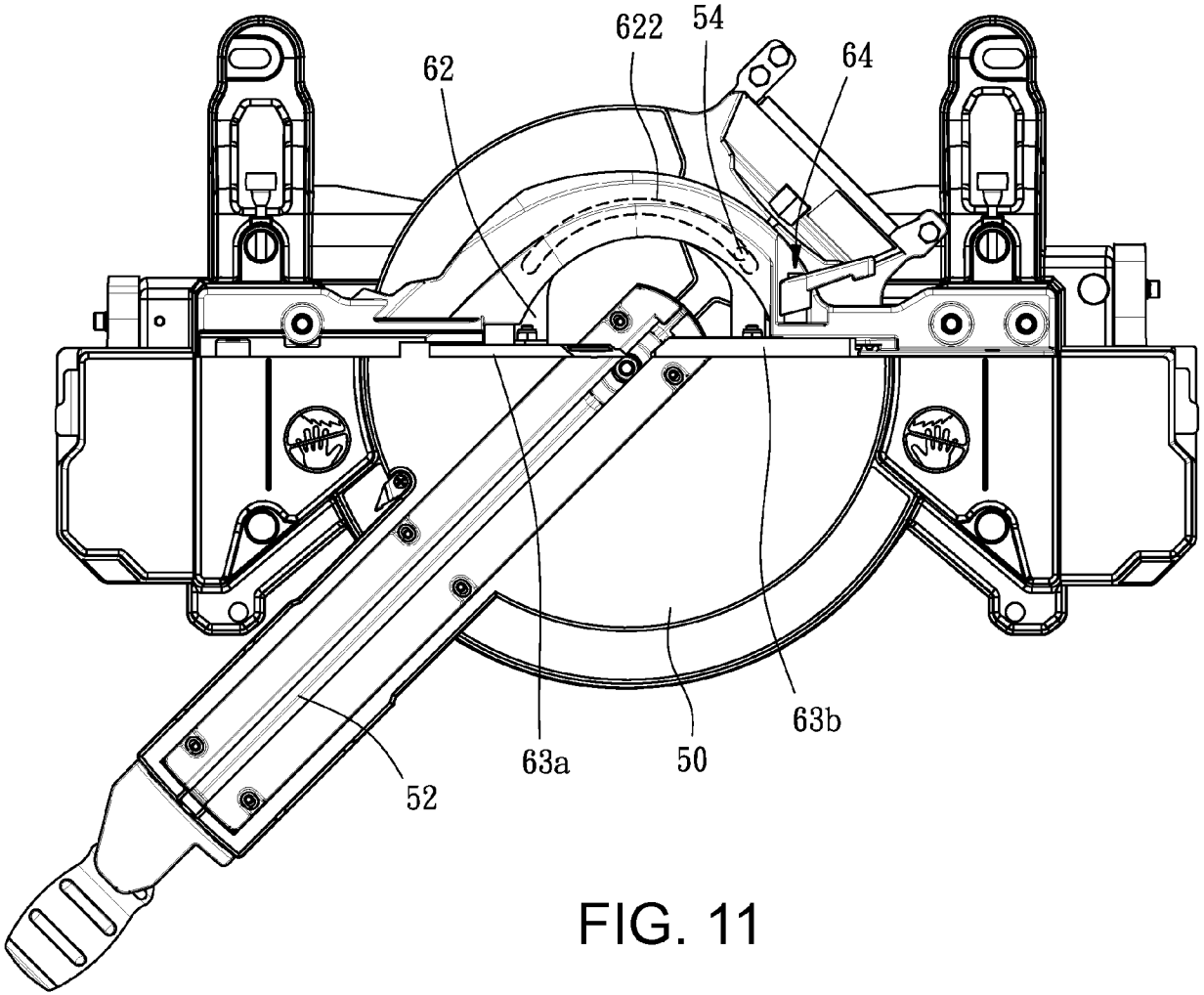
FIG. 11 corresponds to FIG. 10, illustrating the rotatable table rotated clockwise (leftwards).
Figure 12:
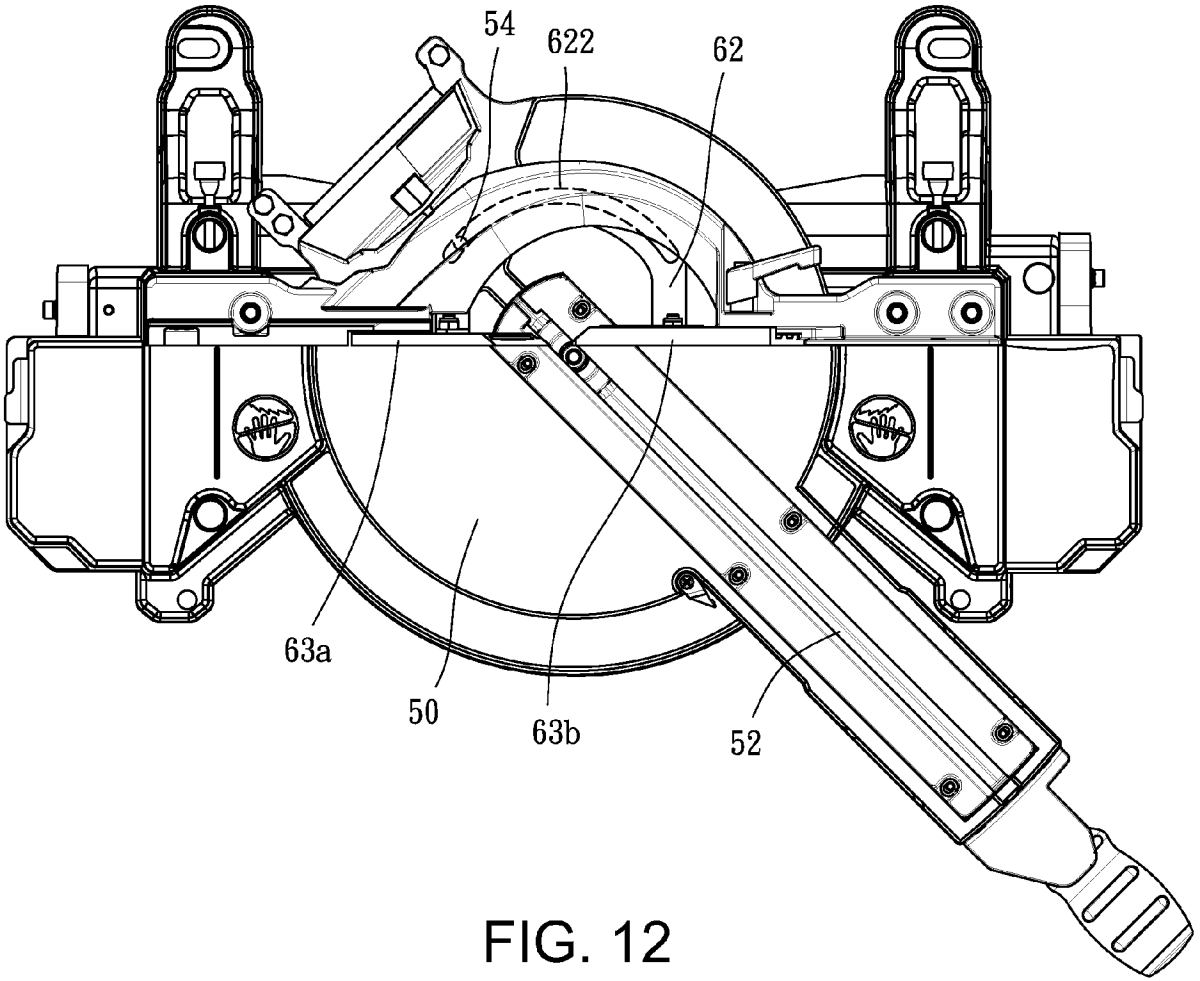
FIG. 12 corresponds to FIG. 11, illustrating the rotatable table rotated counterclockwise (rightwards).

In order to turn the rotatable table 50 clockwise (leftward) to a predetermined angle, the hold-down device 64 of the fence unit 60 must be manipulated to release the hold-down block 618 from the movable fence 63*b*, and then the rotatable table 50 can be rotated to a desired angle. When rotating the rotatable table 50, because the curvature of the arc shaped locating groove 622 is greater than the curvature of the circumference of the rotatable table 50, as shown in FIG. 11, the guide member 54 of the rotatable table 50 is forced against the sides of the arc shaped locating groove 622 of the connection member 62 to cause movement of the connection member 62 and the movable fences 63*a* and 63*b* radially leftwards relative to the rotatable table 50. Thus, the movable fences 63*a* and 63*b* can be maintained spaced from the cutting groove 52 at a proper distance during rotation of the rotatable table 50. After the rotatable table 50 has been rotated to the desired angular position, the hold-down device 64 can be fastened tight to lock the movable fence 63*b* for allowing the performance of the cutting operation. Similarly, when rotating the rotatable table 50 counterclockwise (rightwards) to a predetermined angle, as shown in FIG. 12, the guide member 54 of the rotatable table 50 is forced against the groove wall of the arc shaped locating groove 622 of the connection member 62 to cause movement of the connection member 62 and the movable fences 63*a* and 63*b* radially rightwards relative to the rotatable table 50. Thus, the movable fences 63*a* and 63*b* can be maintained spaced from the cutting groove 52 at a proper distance during rotation of the rotatable table 50.

In conclusion, the design of the present disclosure enables the movable fences to be maintained spaced from the cutting groove of the rotatable table at a proper distance during rotation of the rotatable table, avoiding interference between the rotatable table and the movable fences and assuring a high level of operation safety.

Although a particular embodiment of the disclosure has been described in detail for purposes of illustration, various modifications and enhancements may be made without departing from the spirit and scope of the disclosure. Accordingly, the disclosure is not to be limited except as by the appended claims.

What is claimed is:

1. A worktable for a circular saw, comprising: a base member;

a rotatable table rotatably mounted to said base member about an axis, and having a cutting groove and a guide member; and a fence unit comprising a mounting frame, a connection member and two movable fences, said mounting frame being affixed to said base member, said connection member disposed between said rotatable table and said mounting frame along a line parallel to said axis and adapted for engagement with said guide member, said two movable fences respectively connected to two distal ends of said connection member such that said two movable fences are located at two opposed lateral sides of said cutting groove and connected to said mounting frame and movable relative to said cutting groove.

2. The worktable for a circular saw according to claim 1, wherein said connection member has an arc shaped locating groove defined therein for engagement with said guide member of said rotatable table.

3. The worktable for a circular saw according to claim 2, wherein said arc shaped locating groove has a curvature greater than a curvature of a circumference of said rotatable table.

4. The worktable for a circular saw according to claim 1, wherein said connection member is substantially arc shaped.

5. The worktable for a circular saw according to claim 4, wherein said connection member has two angled end portions, each having a hold-down block mounted thereon; each said movable fence has a sliding groove defined therein adapted for receiving one hold-down block of said connection member; each said sliding groove has a shoulder formed thereon, and said shoulder is secured between one angled end portion of said connection member and said hold-down block of said connection member.

6. The worktable for a circular saw according to claim 1, wherein said mounting frame of said fence unit comprises two locating blocks; and each said movable fence has a sliding groove defined therein for respectively receiving said locating blocks of said mounting frame.

7. The worktable for a circular saw according to claim 6, wherein said fence unit comprises a hold-down device mounted to said mounting frame movable relative to said movable fences and engaged with one of said two locating blocks; and said one engaged locating block is driven by said hold-down device to move toward and engage the corresponding movable fence and to hold down the corresponding movable fence.

8. The worktable for a circular saw according to claim 7, wherein said hold-down device of said fence unit comprises a screw bolt, a nut and a socket; said screw bolt is inserted through a through hole defined in said mounting frame, and a first end of said screw bolt is engaged with the corresponding locating block; said nut is threaded onto an opposed second end of said screw bolt, and said socket is coaxially arranged with said nut; and said socket has a handle extended from a periphery thereof allowing for movement of the handle by an external force to rotate said socket and said nut.

9. The worktable for a circular saw according to claim 1, wherein said guide member protrudingly extends axially from said rotatable table.

10. The worktable for circular saw according to claim 1, wherein said guide member is a pin fixedly fastened to said rotatable table. pg,14

* * * * *